US011320762B1

(12) United States Patent
Kojima

(10) Patent No.: US 11,320,762 B1
(45) Date of Patent: May 3, 2022

(54) IMAGE FORMING APPARATUS

(71) Applicant: TOSHIBA TEC KABUSHIKI KAISHA, Tokyo (JP)

(72) Inventor: Takahiro Kojima, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/203,576

(22) Filed: Mar. 16, 2021

(51) Int. Cl.
*G03G 15/043* (2006.01)
*G03G 15/00* (2006.01)

(52) U.S. Cl.
CPC ..... *G03G 15/043* (2013.01); *G03G 15/5041* (2013.01); *G03G 2215/0158* (2013.01)

(58) Field of Classification Search
CPC ..... G03G 15/04072; G03G 15/043; G03G 15/5041; G03G 15/5058; G03G 2215/0158
See application file for complete search history.

(56) References Cited

U.S. PATENT DOCUMENTS 6,160,569 A * 12/2000 Fujimori ..... H04N 1/295 347/262
2006/0209167 A1* 9/2006 Shiraishi ..... H04N 1/40012 347/232
2011/0280599 A1 11/2011 Ino et al.
2017/0329265 A1* 11/2017 Takezawa ..... G03G 15/043
2017/0336732 A1* 11/2017 Mizuno ..... G03G 15/0435
2019/0163087 A1* 5/2019 Ishida ..... G03G 15/043

FOREIGN PATENT DOCUMENTS

JP 2001-265090 9/2001
JP 2007-271866 10/2007
JP 2009-282349 12/2009
JP 2014-048633 3/2014

* cited by examiner

*Primary Examiner* — Carla J Therrien
(74) *Attorney, Agent, or Firm* — Foley & Lardner LLP

(57) ABSTRACT

An image forming apparatus including a controller configured to switch between a first speed printing where a polygon mirror rotates at a first speed and laser light is at a first power and a second speed printing where the polygon mirror rotates at a second speed slower than the first speed and laser light is at a second power lower than the first power. The polygon mirror rotates at the first speed and laser light is at the first power when a first test pattern is formed. The polygon mirror rotates at the first speed and laser light is at the second power when a second test pattern is formed. The first speed printing is executed based on a detection result of the first test pattern. The second speed printing is executed based on a detection result of the second test pattern.

20 Claims, 4 Drawing Sheets

IMAGE FORMING APPARATUS

FIELD

Embodiments described herein relate generally to an image forming apparatus.

BACKGROUND

An image forming apparatus includes a plurality of process units, an exposure unit, a transfer mechanism, and a fixing unit. The process unit includes a photoconductor and a developing unit. In the image forming apparatus, the photoconductor that is charged and rotates is irradiated with laser light from the exposure unit based on an image to form an electrostatic latent image on the photoconductor. In the image forming apparatus, the developing unit attaches toner to the electrostatic latent image on the photoconductor to form a toner image on the photoconductor. In the image forming apparatus, the transfer mechanism transfers the toner image on the photoconductor to a recording medium such as paper. In the image forming apparatus, the fixing unit fixes the toner image transferred to the recording medium.

The exposure unit may be, for example, an electrophotographic exposure unit using a laser scanning unit (LSU). The exposure unit includes a plurality of laser light sources, a polygon mirror, a plurality of optical members, and a photodetector. The laser light source outputs laser light. The polygon mirror includes a plurality of reflection surfaces that reflect the laser light output from the laser light source and rotates at a predetermined speed. The optical members cause the laser light reflected from the reflection surfaces of the polygon mirror to be incident on the photoconductor. The photodetector detects the laser light output from the laser light source and reflected from the polygon mirror.

With this configuration, the laser light output from the laser light source is reflected from the reflection surfaces of the rotating polygon mirror such that a traveling direction of the laser light changes over time. As a result, the laser light output from the laser light source is deflected to scan the photoconductor in a main scanning direction. In addition, in the image forming apparatus, a timing at which the laser light is output from the laser light source is controlled based on a timing at which the laser light is detected by the photodetector.

In addition, the image forming apparatus executes printing at a normal speed and executes printing at a reduced speed slower than the normal speed. When the print speed is reduced, the rotation speed of the polygon mirror, the rotation speed of the photoconductor are also reduced. In this way, when the print speed is reduced such that the rotation speed of the polygon mirror, the rotation speed of the photoconductor, and the like are reduced, the exposure time for which the photoconductor is exposed to laser light increases to be long relative to the normal speed. For example, when the laser power of laser light output from the laser light source is the same and the exposure time increases, the laser power to which the photoconductor is exposed per unit time increases. As a result, the density of the toner image formed on the recording medium increases. Therefore, in the image forming apparatus, in order to reduce the print speed, the laser power of laser light output from the laser light source is reduced to suppress a change in the density of the toner image.

Due to an attachment error or a manufacturing variation of the process units, however, there may be a misregistration in the position of the toner image transferred from the photoconductor to an image carrier such as a transfer belt of the transfer mechanism. Therefore, in the image forming apparatus, a toner image of a test pattern is formed on the image carrier, a correction parameter is generated based on the detection result of the test pattern, a timing at which the photoconductor is irradiated with light from the exposure unit is controlled based on the correction parameter. As described above, in the image forming apparatus, a color misregistration correction process of controlling the timing at which the photoconductor of each of the process units is irradiated with laser light based on a position where the test pattern is formed on the image carrier is performed.

When the power of laser light output from the laser light source changes, a period of time from when the laser light is incident on the photodetector to when a signal representing the detection of the laser light by the photodetector is output changes. Therefore, in the image forming apparatus, it is necessary to generate the correction parameter for the color misregistration correction process for each print speed, and there is a problem in that a long period of time is required to generate the parameter.

DETAILED DESCRIPTION

In general, according to at least one embodiment, there is provided an image forming apparatus including: a photoconductor configured to rotate; a laser light source configured to output laser light according to an image; a polygon mirror configured to reflect the laser light while rotating and to cause the laser light to be incident on the photoconductor in a main scanning direction to form an electrostatic latent image on the photoconductor; a developing unit configured to attach toner to the electrostatic latent image of the photoconductor to form a toner image; a transfer mechanism configured to transfer the toner image on the photoconductor to an image carrier; a first photodetector configured to detect the toner image formed on the image carrier; and a controller configured to switch between a first speed printing where a rotation speed of the polygon mirror is a first speed and laser light is output from the laser light source at a first laser power and a second speed printing where a rotation speed of the polygon mirror is a second speed slower than the first speed and laser light is output from the laser light source at a second laser power lower than the first laser power. The controller causes the polygon mirror to rotate at the first speed and causes the laser light source to output laser light at the first laser power such that a first test pattern is formed on the image carrier, causes the polygon mirror to rotate at the first speed and causes the laser light source to output laser light at the second laser power such that a second test pattern is formed on the image carrier, controls the first speed printing based on a detection result of the first test pattern by the first photodetector, and controls the second speed printing based on a detection result of the second test pattern by the first photodetector.

Hereinafter, an image forming apparatus according to an embodiment will be described with reference to the drawings.

Figure 1:
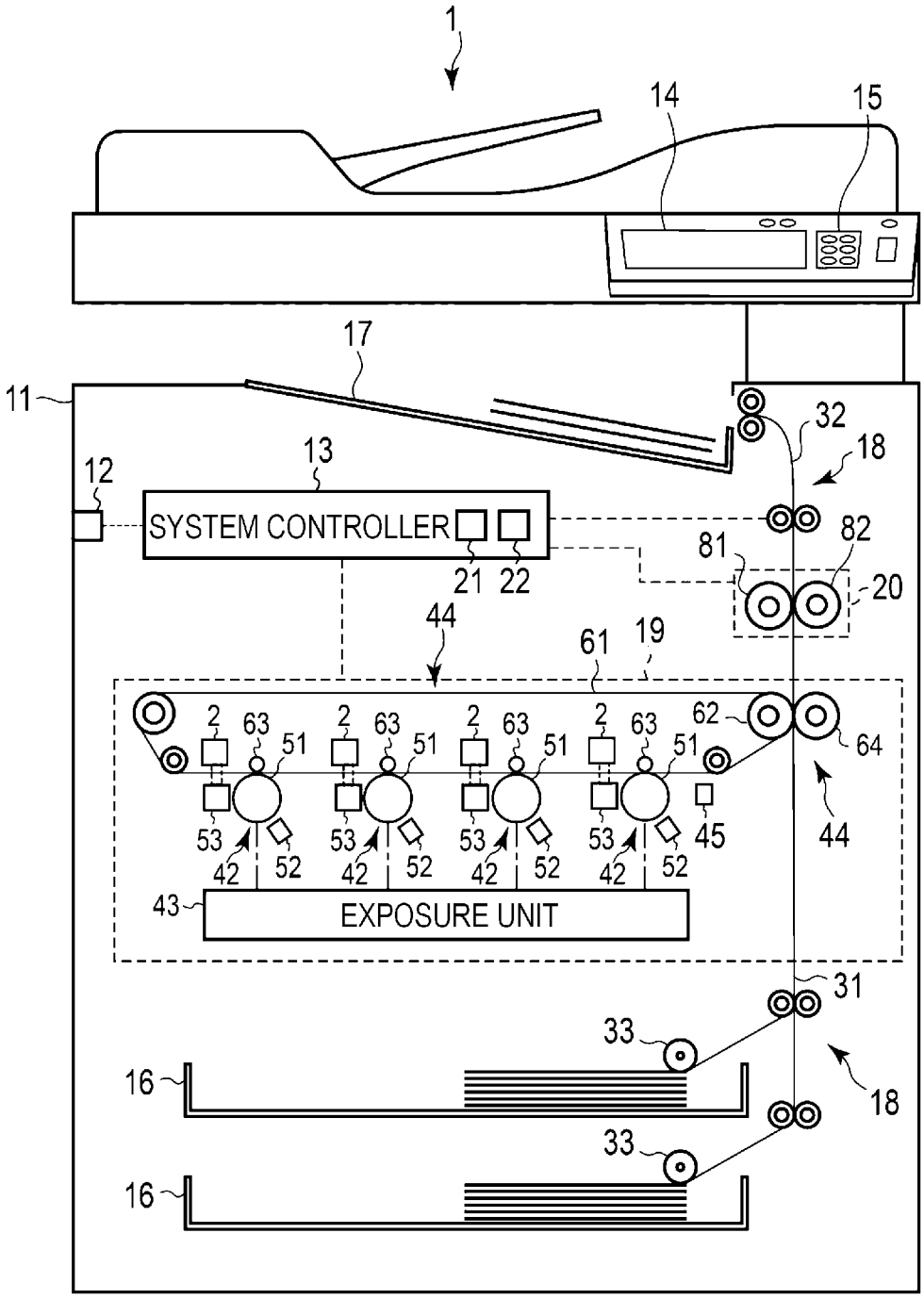
FIG. 1 is a diagram illustrating a configuration example of an image forming apparatus according to at least one embodiment.

FIG. 1 is a diagram illustrating a configuration example of an image forming apparatus 1 according to at least one embodiment.

The image forming apparatus 1 is, for example, a multifunction printer (MFP) that executes various processes such as an image forming process while conveying a recording medium. The image forming apparatus 1 has a configuration in which an image is formed on a recording medium using toner supplied from a toner cartridge.

For example, the image forming apparatus 1 is configured to receive toner from a toner cartridge 2 and to form an image on a recording medium using the received toner. The image forming apparatus 1 receives toners of different colors such as cyan, magenta, yellow, and black from a plurality of toner cartridges 2 containing the respective color toners and forms toner images.

As illustrated in FIG. 1, the image forming apparatus 1 includes a housing 11, a communication interface 12, a system controller 13, a display unit 14, an operation interface 15, a plurality of paper feed cassettes 16, a paper discharge tray 17, a conveyance mechanism 18, an image forming unit 19, and a fixing unit 20.

The housing 11 is a main body of the image forming apparatus 1. The housing 11 accommodates the communication interface 12, the system controller 13, the display unit 14, the operation interface 15, the paper feed cassettes 16, the paper discharge tray 17, the conveyance mechanism 18, the image forming unit 19, and the fixing unit 20.

The communication interface 12 is an interface for relaying communication with another apparatus. The communication interface 12 is used for communication with, for example, a client. The client is, for example, an information processing apparatus such as a personal computer, a smartphone, or a tablet PC. The communication interface 12 is configured as, for example, a LAN connector. In addition, the communication interface 12 may execute wireless communication with the client in accordance with a standard such as Bluetooth (registered tradename) or Wi-fi (registered tradename).

The system controller 13 controls the image forming apparatus 1. The system controller 13 includes, for example, a processor 21 and a memory 22.

The processor 21 may be an arithmetic element that executes arithmetic processing. The processor 21 is, for example, a CPU. The processor 21 executes various processes based on data such as programs stored in the memory 22. The processor 21 functions as a control unit that can execute various operations by executing the programs stored in the memory 22.

The memory 22 is a storage medium that stores the programs and the data used in the programs. In addition, the memory 22 also functions as a working memory. That is, the memory 22 stores, for example, data that is being processed by the processor 21 and the programs that are executed by the processor 21.

The processor 21 executes various information processing by executing the programs stored in the memory 22. For example, the processor 21 controls data transmission and reception by the communication interface 12, screen display by the display unit 14, operation input by the operation interface 15, conveyance of the recording medium by the conveyance mechanism 18, an image forming process by the image forming unit 19, a fixing process by the fixing unit 20, and the like. In addition, the processor 21 generates a print job based on an image acquired from an external apparatus via the communication interface 12. The processor 21 stores the generated print job in the memory 22.

The print job includes image data representing an image that is formed on the recording medium. The image data may be data for forming on a single recording medium or may be data for forming an image on a plurality of recording media. Further, the print job may include information representing whether the printing is color printing or monochrome printing.

In addition, the processor 21 functions as a controller (engine controller) that controls operations of the conveyance mechanism 18, the image forming unit 19, and the fixing unit 20 by executing the programs stored in the memory 22. That is, the processor 21 controls the conveyance of the recording medium by the conveyance mechanism 18. In addition, the processor 21 controls the formation of an image on the recording medium by the image forming unit 19. In addition, the processor 21 controls the fixing of the image to the recording medium by the fixing unit 20.

The image forming apparatus 1 may be configured to include an engine controller separately from the system controller 13. For example, the image forming apparatus 1 may include engine controllers corresponding to the conveyance mechanism 18, the image forming unit 19, and the fixing unit 20, respectively. That is, the image forming apparatus 1 may include an engine controller that controls the conveyance of the recording medium by the conveyance mechanism 18, an engine controller that controls the formation of an image on the recording medium by the image forming unit 19, an engine controller that controls the fixing of the image to the recording medium by the fixing unit 20. In this case, the system controller 13 supplies information required for the control in the engine controller to the engine controller.

The display unit 14 includes a display that displays a screen according to an input video signal. For example, the display of the display unit 14 displays a screen for various settings of the image forming apparatus 1.

The operation interface 15 includes an operation member that generates an operation signal based on an operation of a user.

The paper feed cassette 16 is a cassette that accommodates the recording medium. The paper feed cassette 16 may be configured to supply the recording medium from the outside of the housing 11. For example, the paper feed cassette 16 is configured to be drawn out from the housing 11.

The paper discharge tray 17 is a tray that supports the recording medium discharged from the image forming apparatus 1.

The conveyance mechanism 18 is configured to supply the recording medium for printing to the image forming unit 19 and to discharge the recording medium on which an image is formed by the image forming unit 19 from the housing. For example, the conveyance mechanism 18 includes a paper feed conveyance path 31 and a paper discharge conveyance path 32.

Each of the paper feed conveyance path 31 and the paper discharge conveyance path 32 moves the recording medium.

The paper feed conveyance path 31 picks up the recording medium from the paper feed cassette 16 and supplies the picked recording medium to the image forming unit 19. The paper feed conveyance path 31 includes a pickup roller 33 corresponding to each of the paper feed cassettes 16. Each of the pickup rollers 33 supplies the recording medium of the paper feed cassette 16 to the paper feed conveyance path 31.

The paper discharge conveyance path 32 is a conveyance path through which the recording medium on which an image is formed is discharged from the housing 11. The recording medium discharged through the paper discharge conveyance path 32 is supported by the paper discharge tray 17.

Next, the image forming unit 19 will be described.

The image forming unit 19 is configured to form an image on the recording medium. Specifically, the image forming unit 19 forms the image on the recording medium based on the print job generated by the processor 21.

The image forming unit 19 includes a plurality of process units 42, an exposure unit 43, a transfer mechanism 44, and a plurality of photodetectors 45. In addition, the image forming unit 19 is configured to attach the toner cartridge 2 to each of the process units 42.

Next, the process units 42 will be described.

The process unit 42 is configured to form a toner image. For example, the process units 42 are provided corresponding to the kinds of toners. For example, the process units 42 correspond to color toners of cyan, magenta, yellow, black, respectively. Specifically, the toner cartridges 2 containing toners of different colors are connected to each of the process units 42. Since the process units 42 have the same configuration, the single process unit 42 will be described as an example.

The process unit 42 includes a photosensitive drum 51, an electrostatic charger 52, and a developing unit 53.

The photosensitive drum 51 is a photoconductor including a cylindrical drum and a photosensitive layer that is formed on an outer circumferential surface of the drum. The photosensitive drum 51 rotates at a predetermined speed.

The electrostatic charger 52 uniformly charges a surface of the photosensitive drum 51. For example, the electrostatic charger 52 applies a voltage to the photosensitive drum 51 such that the photosensitive drum 51 is uniformly charged to a potential having a negative polarity.

The developing unit 53 attaches the toner to the photosensitive drum. The developing unit 53 includes, for example, a developer container, an agitating mechanism, a developing roller, and a doctor blade.

The developer container is a container that receives and contains the toner supplied from the toner cartridge 2. The developer container contains a carrier in advance. The toner supplied from the toner cartridge 2 is agitated by the agitating mechanism together with the carrier to form a developer in which the toner and the carrier are mixed. The carrier is provided in the developer container, for example, during manufacturing of the developing unit 53.

The developing roller rotates in the developer container such that the developer is attached to the surface. The doctor blade is a member disposed at a predetermined distance from the surface of the developing roller. The doctor blade removes a part of the developer attached to the surface of the rotating developing roller. As a result, a layer of the developer having a thickness corresponding to the distance between the doctor blade and the surface of the developing roller is formed on the surface of the developing roller.

Next, the exposure unit 43 will be described.

The exposure unit 43 is, for example, an electrophotographic exposure unit using a laser scanning unit (LSU). The exposure unit 43 outputs laser light corresponding to an image to be printed and irradiates the charged photosensitive drum 51 of each of the process units 42 with the laser light. The exposure unit 43 deflects laser light for scanning the photosensitive drum 51 in a main scanning direction parallel to a rotation axis of the photosensitive drum 51. As a result, the exposure unit 43 forms an electrostatic latent image corresponding to one line on the photosensitive drum 51. The exposure unit 43 forms an electrostatic latent image corresponding to a plurality of lines on the photosensitive drum 51 by continuously irradiating the rotating photosensitive drum 51 with light. In this state, when the layer of the developer formed on the surface of the developing roller of the developing unit 53 approaches the surface of the photosensitive drum 51, the toner in the developer is attached to the electrostatic latent image formed on the surface of the photosensitive drum 51. As a result, a toner image is formed on the surface of the photosensitive drum 51. A detailed configuration of the exposure unit 43 is described below.

Next, the transfer mechanism 44 is described.

The transfer mechanism 44 is configured to transfer the toner image formed on the surface of the photosensitive drum 51 to the recording medium. The transfer mechanism 44 includes, for example, a primary transfer belt 61, a secondary transfer facing roller 62, a plurality of primary transfer rollers 63, and a secondary transfer roller 64.

The primary transfer belt 61 is an endless belt that is wound around the secondary transfer facing roller 62 and a plurality of winding rollers. In the primary transfer belt 61, an inner circumferential surface as an inner surface is in contact with the secondary transfer facing roller 62 and the winding rollers, and an outer circumferential surface as an outer surface faces the photosensitive drum 51 of the process unit 42.

The secondary transfer facing roller 62 rotates to convey the primary transfer belt 61 in a predetermined conveying direction. The winding rollers are configured to be freely rotatable. The winding rollers rotate according to the movement of the primary transfer belt 61 by the secondary transfer facing roller 62.

The primary transfer rollers 63 are configured to bring the primary transfer belt 61 into contact with the photosensitive drums 51 of the process units 42, respectively. The primary transfer rollers 63 are provided corresponding to the photosensitive drums 51 of the process units 42. Specifically, the primary transfer rollers 63 are provided at positions where the primary transfer rollers 63 and the photosensitive drums 51 of the process units 42 corresponding thereto face each other with the primary transfer belt 61 interposed therebetween. The primary transfer roller 63 comes into contact with the inner circumferential surface side of the primary transfer belt 61 and displaces the primary transfer belt 61 to the photosensitive drum 51 side. As a result, the primary transfer roller 63 brings the outer circumferential surface of the primary transfer belt 61 into contact with the photosensitive drum 51.

The secondary transfer roller 64 is provided at a position where the secondary transfer roller 64 faces the primary transfer belt 61. The secondary transfer roller 64 comes into contact with the outer circumferential surface of the primary transfer belt 61 and applies a pressure. As a result, a transfer nip where the secondary transfer roller 64 and the outer circumferential surface of the primary transfer belt 61 are in close contact with each other is formed. When the recording medium passes through the transfer nip, the secondary transfer roller 64 presses the recording medium that passes through the transfer nip against the outer circumferential surface of the primary transfer belt 61.

The secondary transfer roller 64 and the secondary transfer facing roller 62 rotate such that the recording medium supplied from the paper feed cassette 16 by the conveyance mechanism 65 is conveyed in a state where the recording medium is interposed between the secondary transfer roller 64 and the secondary transfer facing roller 62. As a result, the recording medium passes through the transfer nip.

In the above-described configuration, when the outer circumferential surface of the primary transfer belt 61 comes into contact with the photosensitive drum 51, the toner image formed on the surface of the photosensitive drum 51 is transferred to the outer circumferential surface of the primary transfer belt 61. When the image forming unit 19 includes the plurality of process units 42, the primary transfer belt 61 receives the toner image from the photosensitive drums 51 of the process units 42. The toner image transferred to the outer circumferential surface of the primary transfer belt 61 is conveyed by the primary transfer belt 61 up to the transfer nip where the secondary transfer roller 64 and the outer circumferential surface of the primary transfer belt 61 are in close contact with each other. When the recording medium is present in the transfer nip, the toner image transferred to the outer circumferential surface of the primary transfer belt 61 is transferred to the recording medium in the transfer nip.

Next, the photodetectors 45 are described.

Figure 2:
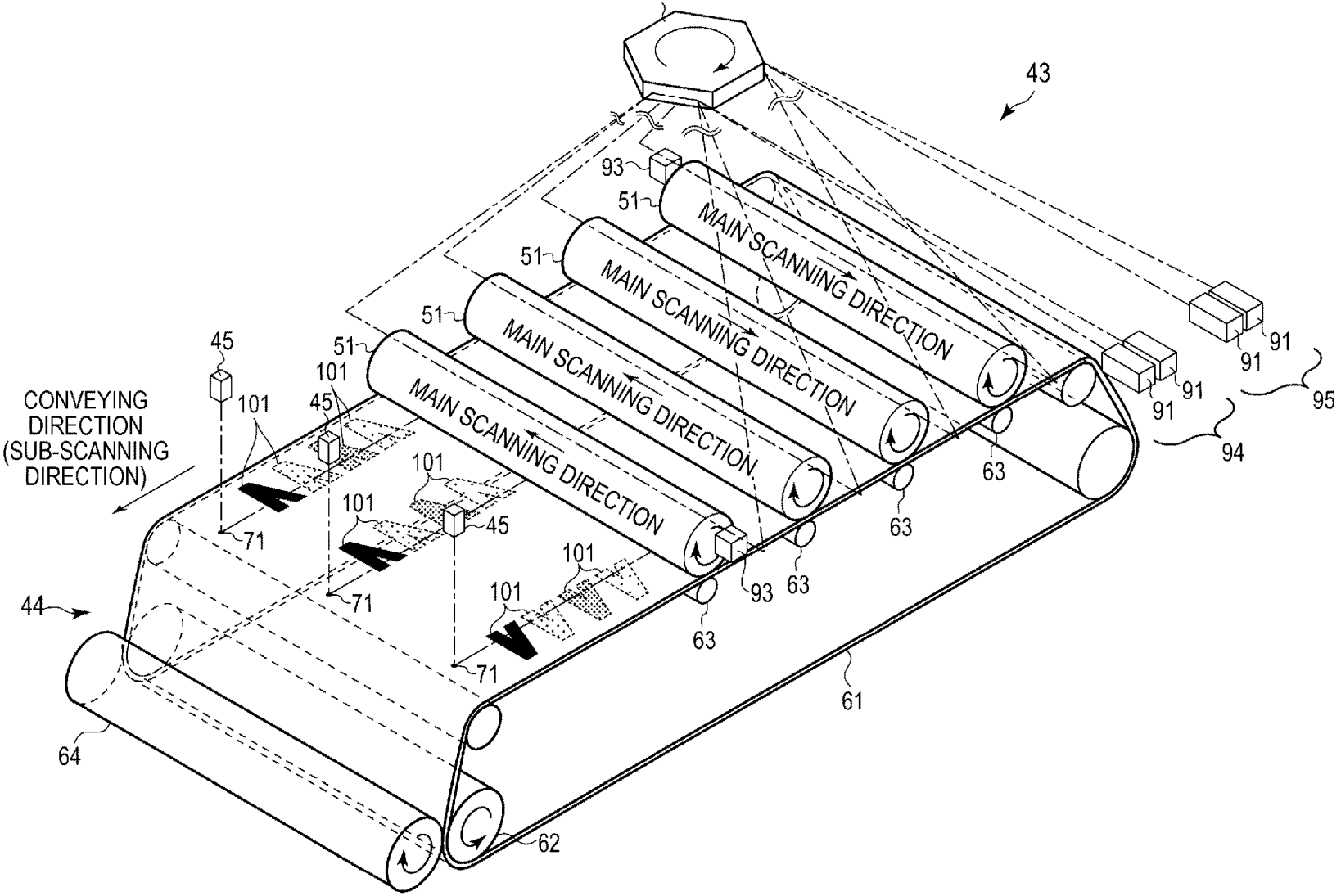
FIG. 2 is a diagram illustrating a configuration example of an exposure unit and a transfer mechanism in the image forming apparatus according to at least one embodiment.

FIG. 2 is a diagram illustrating a configuration example of the periphery of a part of the process units 42 and the transfer mechanism 44 in the image forming unit 19. FIG. 2 is a perspective view illustrating the transfer mechanism 44 of the image forming unit 19 when seen from the exposure unit 43 and the photosensitive drums 51 side.

Each of the photodetectors 45 includes a sensor that outputs an electrical signal corresponding to irradiated light and an optical system that causes light to be incident on the sensor. Each of the photodetectors 45 converts light incident on the sensor from a detection position 71 through the optical system into an electrical signal and outputs the converted electrical signal to the system controller 13.

Each of the photodetectors 45 is disposed to detect one point on the outer circumferential surface of the primary transfer belt 61. Each of the photodetectors 45 detects whether or not a toner image is present at the detection position 71. For example, as illustrated in FIG. 2, the photodetectors 45 are arranged such that the detection positions 71 are aligned in a direction parallel to the main scanning direction to be present at different positions in the main scanning direction.

Next, a configuration of the image forming apparatus 1 relating to fixing is described.

The fixing unit 20 fixes the toner image by fusing the toner transferred to the recording medium. The fixing unit 20 operates based on a control of the system controller 13. The fixing unit 20 includes a heating member that applies heat to the recording medium and a pressurizing member that applies pressure to the recording medium. For example, the heating member is, for example, a heating roller 81. In addition, the pressurizing member is, for example, a press roller 82.

The heating roller 81 is a fixing rotor that rotates. The heating roller 81 includes a hollow core that is formed of metal and an elastic layer that is formed on an outer circumference of the core. The heating roller 81 is heated to a high temperature by a heater disposed inside the core formed in a hollow shape. The heater is, for example, a halogen heater. In the alternative, the heater may be an induction heating (IH) heater that heats the core using electromagnetic induction.

The press roller 82 is provided at a position facing the heating roller 81. The press roller 82 includes a core that has a predetermined outer diameter and is formed of metal and an elastic layer that is formed on an outer circumference of the core. The press roller 82 applies pressure to the heating roller 81. By the press roller 82 applying pressure to the heating roller 81, a fixing nip where the press roller 82 and the heating roller 81 are in close contact with each other is formed. The press roller 82 rotates such that the recording medium entering the fixing nip is moved and pressed against the heating roller 81.

With the above-described configuration, the heating roller 81 and the press roller 82 apply heat and pressure to the recording medium that passes through the fixing nip. As a result, the toner image is fixed to the recording medium that passes the fixing nip. The recording medium that passes the fixing nip is discharged to the outside of the housing 11 by the conveyance mechanism 18. The fixing unit 20 is not limited to the above-described arrangement. The fixing unit 20 may be configured as an on-demand type in which heat is applied to the recording medium to which the toner image is transferred through a film-shaped member such that the toner is fused and fixed.

Next, the configuration of the exposure unit 43 is described in detail.

FIG. 2 is a diagram illustrating a position relationship of the exposure unit 43 relative to the photosensitive drum 51. In the description of at least one embodiment, it is assumed that the exposure unit 43 corresponds to a laser scanning unit (LSU) and has a configuration in which optical members for scanning are disposed on both sides of a polygon mirror. In addition, in the example of FIG. 2, the process units 42 are arranged in order of yellow, magenta, cyan, and black from the most distant side from the transfer nip.

As illustrated in FIG. 2, the exposure unit 43 may include a plurality of laser light sources 91, a polygon mirror 92, a plurality of optical members, and a plurality of photodetectors 93.

The laser light source 91 outputs laser light. The laser light source 91 is, for example, a laser diode. The laser light source 91 is provided, for example, for each of the process units 42. That is, the laser light source 91 is provided for each of the colors such as cyan, magenta, yellow, and black.

The polygon mirror 92 is a rotating polygon mirror that includes a plurality of reflection surfaces reflecting the laser light output from the laser light source 91 and rotates at a predetermined speed. The reflection surface is provided such that an angle with respect to an incidence direction of the laser light changes depending on the rotation of the polygon mirror 92. The polygon mirror 92 is rotated by a driving mechanism at the predetermined speed and reflects the laser light output from each of the laser light sources 91 with the reflection surfaces such that a traveling direction of the laser light changes over time. As a result, the polygon mirror 92 deflects the laser light output from each of the laser light sources 91 to scan the photosensitive drum 51 of each of the process units 42 in the main scanning direction.

The optical members are light guide members that cause the laser light reflected from the reflection surfaces of the polygon mirror 92 to be incident on the photosensitive drum 51. The optical member is, for example, a reflecting mirror or a scanning lens that is provided for each of the process units 42. The optical member may be provided for each of the colors such as cyan, magenta, yellow, and black.

The optical member corresponding to cyan causes the laser light output from the laser light source 91 corresponding to cyan and reflected from the polygon mirror 92 to be incident on the photosensitive drum 51 of the process unit 42 corresponding to cyan. In addition, the optical member corresponding to magenta causes the laser light output from the laser light source 91 corresponding to magenta and reflected from the polygon mirror 92 to be incident on the photosensitive drum 51 of the process unit 42 corresponding to magenta. In addition, the optical member corresponding to yellow causes the laser light output from the laser light source 91 corresponding to yellow and reflected from the polygon mirror 92 to be incident on the photosensitive drum 51 of the process unit 42 corresponding to yellow. In addition, the optical member corresponding to black causes the laser light output from the laser light source 91 corresponding to black and reflected from the polygon mirror 92 to be incident on the photosensitive drum 51 of the process unit 42 corresponding to black.

The photodetector 93 is a beam detector that detects the laser light output from the laser light source 91 and reflected from the polygon mirror 92. In addition, the photodetector 93 may be a BD sensor. The photodetector 93 includes, for example, a photodiode, a phototransistor, or another element that generates an electrical signal corresponding to light. When the photodetector 93 detects laser light, the photodetector 93 outputs a beam detection signal (BD signal).

The photodetector 93 is disposed on an optical path of the laser light reflected from the polygon mirror 92. That is, the photodetector 93 is disposed at a position where the laser light that is reflected from the polygon mirror 92 and is deflected to scan the photosensitive drum 51 of each of the process units 42 in the main scanning direction is incident.

The laser light sources 91, the optical members, and the photodetectors 93 are classified into a first system 94 and a second system 95. For example, the laser light sources 91, the optical members, and the photodetector 93 corresponding to black and cyan are classified into the first system 94. In addition, for example, the laser light sources 91, the optical members, and the photodetector 93 corresponding to magenta and yellow are classified into the second system 95. At least one photodetector 93 is provided for each of the systems. That is, the photodetector 93 is provided for each of the first system 94 and the second system 95.

In this case, the first system 94 includes the laser light source 91 corresponding to cyan, the optical member corresponding to cyan, the laser light source 91 corresponding to black, the optical member corresponding to black, and the photodetector 93. The photodetector 93 of the first system 94 is provided at a position where the laser light that is output from the laser light source 91 corresponding to black and is deflected from the polygon mirror 92 is incident.

In addition, the second system 95 includes the laser light source 91 corresponding to yellow, the optical member corresponding to yellow, the laser light source 91 corresponding to magenta, the optical member corresponding to magenta, and the photodetector 93. The photodetector 93 of the second system 95 is provided at a position where the laser light that is output from the laser light source 91 corresponding to yellow and is deflected from the polygon mirror 92 is incident.

Combinations of the members classified into the first system 94 and the second system 95 may be freely set. For example, the respective units may be disposed such that the first system 94 corresponds to one color and the second system 95 corresponds to three colors.

Next, an operation of the exposure unit 43 is described.

In the above-described configuration, the processor 21 of the system controller 13 inputs image data for printing to the exposure unit 43. The image data represents the density of each of the colors.

The exposure unit 43 converts the image data into a drive signal of the laser light source 91 for each of the colors such as cyan, magenta, yellow, and black and inputs the drive signal to each of the laser light sources 91. As a result, the laser light is output from the laser light source 91.

The laser light output from each of the laser light sources 91 is reflected from the reflection surface of the rotating polygon mirror 92. Therefore, the traveling direction of the laser light incident on the polygon mirror 92 changes depending on the rotation of the polygon mirror 92. The laser light reflected from the polygon mirror 92 is deflected to scan the photosensitive drum 51 corresponding thereto in the main scanning direction through the optical member. That is, the entire area of the corresponding photosensitive drum 51 is irradiated with the laser light output from the laser light source 91 in the main scanning direction.

In addition, the photodetector 93 detects the laser light reflected from the polygon mirror 92 and outputs the BD signal to the system controller 13.

The processor 21 of the system controller 13 generates a synchronization signal. The synchronization signal is, for example, a main scanning counter that is a reference to a timing of the operation for each of the systems. The processor 21 determines an image data area on the main scanning counter based on the BD signal. For example, the processor 21 determines a predetermined position on the main scanning counter, that is, a predetermined count range of the main scanning counter as the image data area.

The image data area is an area where an electrostatic latent image is formed on the photosensitive drum 51 based on the image data. The image data area represents an exposure start position and an exposure end position. The exposure start position represents a timing at which irradiation with laser light based on the image data starts. Specifically, the exposure start position represents a count value of the main scanning counter where irradiation with laser light based on the image data starts. The exposure end position represents a timing at which irradiation with laser light based on the image data ends. Specifically, the exposure end position represents a count value of the main scanning counter where irradiation with laser light based on the image data ends. An interval between the exposure start position and the exposure end position is determined depending on the size of the recording medium to be printed.

In addition, the processor 21 resets the main scanning counter based on the BD signal. That is, the processor 21 resets the main scanning counter at a timing at which the BD signal is input from the photodetector 93. As a result, the timing at which the main scanning counter is "0" is determined, and the exposure start position and the exposure end position on the next line are determined.

For example, the processor 21 determines the exposure start position and the exposure end position of the laser light source 91 of the first system 94 based on the timing at which the BD signal is input from the photodetector 93 of the first system 94. In addition, for example, the processor 21 determines the exposure start position and the exposure end position of the laser light source 91 of the second system 95 based on the timing at which the BD signal is input from the photodetector 93 of the second system 95.

The processor 21 controls the exposure unit 43 such that the laser light corresponding to the image data is output from the laser light source 91 for the area from the exposure start position to the exposure end position. For example, the processor 21 inputs the image data corresponding to one line to the exposure unit 43 and executes exposure for the area from the exposure start position to the exposure end position. As a result, the laser light corresponding to the image data is output from each of the laser light sources 91 for the area from the exposure start position to the exposure end position. As a result, the laser light reflected from the polygon mirror 92 is deflected to scan each of the photoconductive drums 51 in the main scanning direction such that an electrostatic latent image is formed on each of the photoconductive drums 51.

In addition, the processor 21 controls the exposure unit 43 such that the laser light is continuously output from the laser light source 91 for the area from the exposure end position to the next exposure start position. As a result, for the area from the exposure end position to the exposure start position, the laser light is incident on the photodetector 93, and the BD signal is input from the photodetector 93 to the system controller 13.

The processor 21 resets the main scanning counter whenever the BD signal is input from the photodetector 93 of each of the systems. As a result, the processor 21 determines the exposure start position and the exposure end position for each line and inputs the image data to the exposure unit 43 for each line.

Next, a relationship between the thermal capacity of the recording medium and the print speed will be described.

Since the period of time required for fixing varies depending on the thermal capacity of the recording medium and the like, the system controller 13 forms an image at a print speed that varies depending on the recording medium. Therefore, the system controller 13 changes a speed at which the recording medium is conveyed, a moving speed of the primary transfer belt 61, a rotation speed of the photosensitive drum 51, and a rotation speed of the polygon mirror 92 depending on the print speed.

Regarding the print speed, for example, a first speed printing and a second speed printing where the print speed is slower than that of the first speed printing are provided. In at least one embodiment, the first speed printing will be referred to as normal speed printing. In addition, the second speed printing will be referred to as reduced speed printing. The normal speed printing is printing where the print speed is "normal speed". The reduced speed printing is printing where the print speed is "reduced speed" slower than the normal speed. The image forming apparatus 1 may be configured to have settings for a large number of print speeds.

The processor of the system controller 13 switches between the normal speed printing and the reduced speed printing based on the kind of the recording medium used for printing, the content of the print job, a setting based on an operation input, or a default setting, for example.

The system controller 13 controls the rotation speed of the polygon mirror 92 to "normal speed" or "reduced speed" slower than the normal speed. In addition, the system controller 13 controls the rotation speed of the photosensitive drum 51 to "normal speed" or "reduced speed" slower than the normal speed. The system controller 13 controls the speed at which the recording medium is conveyed by the conveyance mechanism 18 to "normal speed" or "reduced speed" slower than the normal speed. The system controller 13 controls the moving speed of the primary transfer belt 61 to "normal speed" or "reduced speed" slower than the normal speed.

When the processor 21 executes the normal speed printing, the processor 21 controls the rotation speed of the polygon mirror 92, the rotation speed of the photosensitive drum 51, the speed at which the recording medium is conveyed by the conveyance mechanism 18, and the moving speed of the primary transfer belt 61 to the normal speed, respectively.

In addition, when the processor 21 executes the reduced speed printing, the processor 21 controls the rotation speed of the polygon mirror 92, the rotation speed of the photosensitive drum 51, the speed at which the recording medium is conveyed by the conveyance mechanism 18, and the moving speed of the primary transfer belt 61 to the reduced speed, respectively.

As described above, when the rotation speeds of the photosensitive drum 51 and the polygon mirror 92 are reduced, the exposure time for which the photosensitive drum 51 is exposed to the laser light increases to be long relative to the normal speed. For example, when the laser power of laser light output from the exposure unit 43 is the same and the exposure time increases, the laser power to which the photoconductor is exposed per unit time increases. As a result, the density of the toner image formed on the recording medium increases.

Therefore, when the print speed is "normal speed" and the rotation speed of the polygon mirror 92 and the rotation speed of the photosensitive drum 51 are the normal speed, the processor 21 of the system controller 13 controls the exposure unit 43 such that the laser light is output at the first laser power. That is, when the print speed is "normal speed", the processor 21 sets the set value of laser power to the first laser power.

In addition, when the print speed is "reduced speed" and the rotation speed of the polygon mirror 92 and the rotation speed of the photosensitive drum 51 are the reduced speed, the processor 21 of the system controller 13 controls the exposure unit 43 such that the laser light is output at the second laser power lower than the first laser power. That is, when the print speed is "reduced speed", the processor 21 sets the set value of laser power to the second laser power.

Next, a color misregistration correction process is described.

In order to maintain the image quality, the processor 21 forms a test pattern with toner and causes the photodetectors 45 to detect the formed test pattern. The processor 21 executes the color misregistration correction process of determining a correction parameter in an image forming process based on the detection results of the photodetectors 45. The color misregistration correction process is a process for correcting a misregistration of the print position for each of the colors. The color misregistration correction process may be referred to as color registration.

As illustrated in FIG. 2, the processor 21 controls the image forming unit 19 such that a test pattern 101 is formed on the primary transfer belt 61 by each of the process units 42. That is, the processor 21 controls the image forming unit 19 such that the test pattern 101 is formed for each of the colors by each of the process units 42.

The test pattern 101 is a toner image that is formed at a position on the primary transfer belt 61 in the main scanning direction where the test pattern 101 can be detected by any one of the photodetectors 45. That is, the test pattern 101 is formed at a position that passes through any one of the detection positions 71.

Leading ends of the test patterns 101 for the colors in the sub-scanning direction are formed by the process units 42 at the same timing, respectively. That is, the leading ends of the test patterns 101 in the sub-scanning direction are formed based on electrostatic latent images corresponding to one line that are formed on the photosensitive drums 51 when the laser light output from the laser light sources 91 at the same timing is incident on the photosensitive drums 51. That is, the test pattern 101 has a side perpendicular to the sub-scanning direction and parallel to the main scanning direction. The side of the test pattern 101 perpendicular to the sub-scanning direction and parallel to the main scanning direction will be referred to as a first side.

In addition, as illustrated in FIG. 2, the test pattern 101 has a portion where the formation position of the toner image changes in the sub-scanning direction depending on positions in the main scanning direction. That is, the test pattern 101 has a side where an angle is formed between the main scanning direction and the sub-scanning direction. The side of the test pattern 101 where an angle is formed between the main scanning direction and the sub-scanning direction will be referred to as a second side.

In addition, a gap where the toner image is not formed is present between the first side and the second side.

A misregistration of the print position for each of the colors in the sub-scanning direction and a misregistration of the print position for each of the colors in the main scanning direction are reflected on the test pattern 101 formed as described above.

When the first side of the test pattern 101 having the above-described shape arrives at the detection position 71 of the photodetector 45, the first side of the test pattern 101 is detected by the photodetector 45 such that the detection result is set to "ON".

Next, when the gap between the first side and the second side of the test pattern 101 arrives at the detection position of the photodetector 45, the detection result of the photodetector 45 is set to "OFF".

Next, when the second side of the test pattern 101 arrives at the detection position 71 of the photodetector 45, the second side of the test pattern 101 is detected by the photodetector 45 such that the detection result is set to "ON" again.

In this case, a time interval between a timing at which the first side of the test pattern 101 is detected, that is, a timing at which the detection result is initially set to "ON" and a timing at which the second side of the test pattern 101 is detected, that is, a timing at which the detection result is secondly set to "ON" changes depending on positions of the test pattern 101 in the main scanning direction.

The processor 21 detects the respective test patterns 101 using the photodetectors 45 and acquires the detection results. The processor 21 executes a registration process of generating a correction parameter for adjusting the formation position of the toner image based on detection result of the test pattern 101 by the photodetector 45. That is, the processor 21 sets the correction parameter such that a misregistration of the print position for each of the colors in the sub-scanning direction, a misregistration of the print position for each of the colors in the main scanning direction, and the like decrease.

For example, the processor 21 functions as a counter that counts the time interval. The processor 21 generates a sub-scanning direction correction parameter for each of the colors based on a count value of the time interval between the timings at which the first side of the test pattern 101 for each of the colors is detected by the single photodetector 45 and a preset first reference value. The first reference value is determined based on the attachment position of each of the process units 42 and the like. That is, the processor 21 determines the degree to which the time interval between the timings at which the first side of the test pattern 101 for each of the colors is detected deviates from the first reference value corresponding to the attachment position of each of the process units 42, and generates the sub-scanning direction correction parameter.

When any one of the colors is set as a reference, the sub-scanning direction correction parameter is information representing the degree to which the print position of another color should be shifted in the sub-scanning direction. For example, the sub-scanning direction correction parameter represents the number of lines by which the formation position of the toner image corresponding to one line should be shifted in the sub-scanning direction for each of the colors, that is, for each of the laser light sources 91 and each of the process units 42.

In addition, the processor 21 generates a main scanning direction correction parameter for each of the colors based on a count value of the time interval between the timing at which the first side of the test pattern 101 is detected by the photodetector 45 and the timing at which the second side of the test pattern 101 is detected by the photodetector 45 and a preset second reference value. The second reference value is a count value of the time interval between the timing at which the first side of the test pattern 101 is detected and the timing at which the second side of the test pattern 101 is detected when the test pattern 101 is formed at a reference position. The processor 21 calculates a difference between the second reference value and the count value of the time interval between the timing at which the first side of the test pattern 101 is detected and the timing at which the second side of the test pattern 101 is detected. The processor 21 determines the degree to which the test pattern 101 deviates in the main scanning direction based on the calculated difference, and generates the main scanning direction correction parameter. The processor 21 calculates the difference from the second reference value for each of the colors and generates the main scanning direction correction parameter for each of the colors.

The main scanning direction correction parameter is information representing the degree to which the print position for each of the colors should be shifted in the main scanning direction. That is, the main scanning direction correction parameter is information representing the shift amount of the exposure start position and the exposure end position for each of the laser light sources 91 and each of the process units 42. The main scanning direction correction parameter represents, for example, the count value of the main scanning counter as the shift amount of the exposure start position and the exposure end position.

The processor 21 controls a timing at which the exposure unit 43 starts to irradiate the photosensitive drum 51 of each of the process units 42 with laser light based on the generated sub-scanning direction correction parameter and the generated main scanning direction correction parameter. That is, the processor 21 controls the position where the toner image is formed on the primary transfer belt 61 by each of the process units 42 based on the generated sub-scanning direction correction parameter and the generated main scanning direction correction parameter.

For example, the processor 21 determines a print start timing based on a timing at which the recording medium to be printed passes through a predetermined position of the paper feed conveyance path 31. For example, the processor 21 determines the print start timing based on the detection result by the sensor that detects the passage of the recording medium in front of the image forming unit 19. Further, the processor 21 shifts the determined print start timing in the sub-scanning direction based on the sub-scanning direction correction parameter. In addition, for example, the processor 21 shifts the exposure start position and the exposure end position in the main scanning direction based on the main scanning direction correction parameter, the exposure start position and the exposure end position being determined based on the size of the recording medium to be printed, that is, the print size. As a result, the processor 21 can shift the position of the toner image to be formed on the primary transfer belt in the main scanning direction and the sub-scanning direction.

As described above, when the print speed is the normal speed, the processor 21 controls the exposure unit 43 such that the laser light is output at the first laser power. When the print speed is the reduced speed, the processor 21 controls the exposure unit 43 such that the laser light is output at the second laser power lower than the first laser power. When the laser power of the laser light output from the exposure unit 43 changes, a period of time from when the laser light is incident on the photodetector 93 to when the BD signal representing the detection of the laser light by the photodetector 93 is output changes.

In at least one embodiment, the processor 21 generates the main scanning direction correction parameter for each of the normal speed and the reduced speed. In other words, the processor 21 generates the main scanning direction correction parameter for each setting of the laser power. For example, the processor 21 generates a first main scanning direction correction parameter for the normal speed printing based on the detection result of the test pattern formed at the first laser power. In addition, for example, the processor 21 generates a second main scanning direction correction parameter for the reduced speed printing based on the detection result of the test pattern formed at the second laser power. The test pattern formed at the first laser power will be referred to as a first test pattern 102, and the test pattern formed at the second laser power will be referred to as a second test pattern 103.

Next, an example of the operation of the image forming apparatus 1 including the color misregistration correction process is described.

Figure 3:
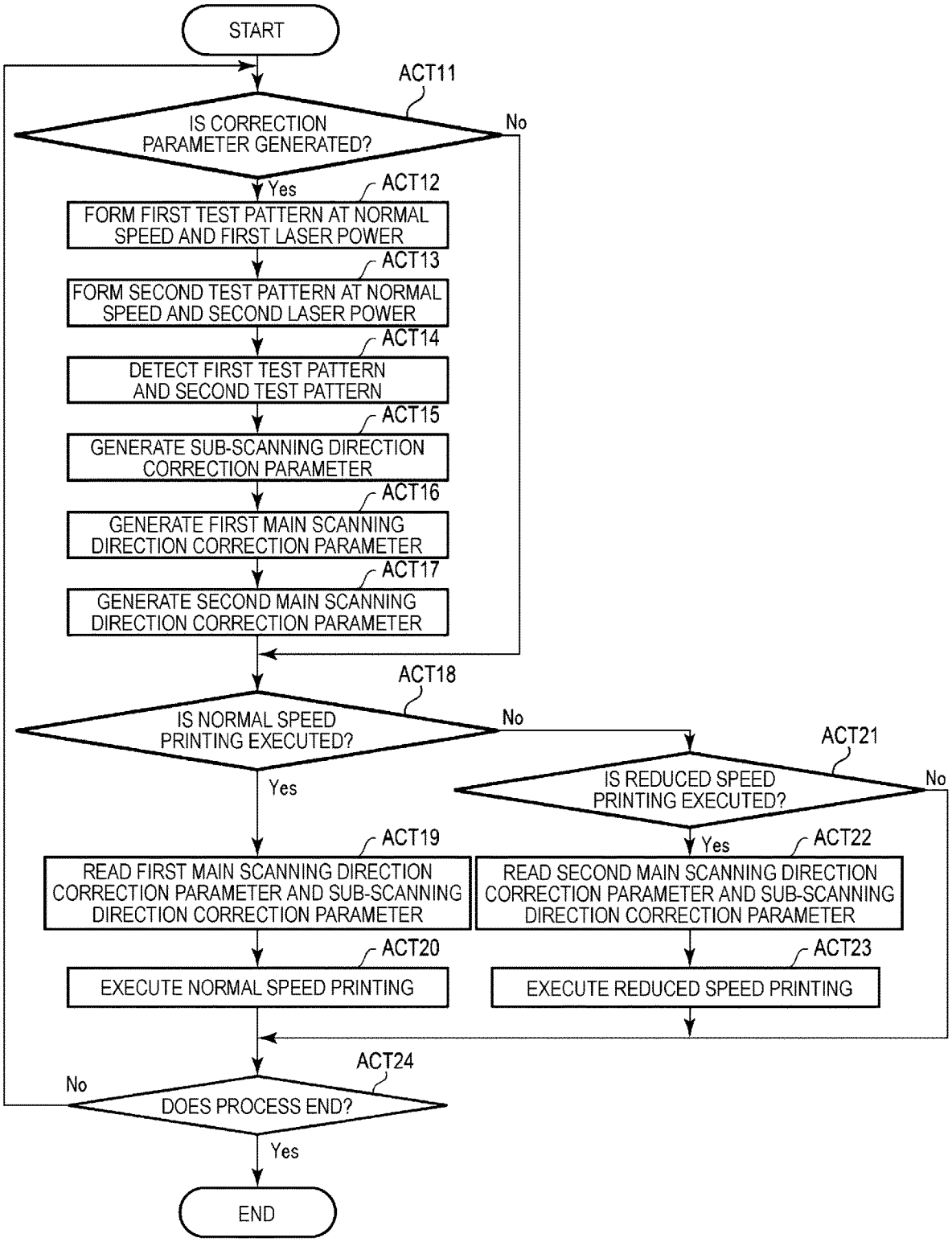
FIG. 3 is a diagram illustrating an example of an operation of the image forming apparatus according to at least one embodiment.

FIG. 3 is a flowchart illustrating an operation example of the image forming apparatus 1.

The processor 21 determines whether or not the generation of the correction parameter, that is, the registration is required (ACT 11). For example, the processor 21 determines to execute the registration during start-up of the image forming apparatus 1. In addition, when the environment such as the temperature and the humidity changes after the previous registration, the processor 21 may determine whether or not to execute the registration again. For example, the processor 21 acquires environment information from the sensor that detects the temperature, the humidity, and the like, and records the acquired environment information in the memory 22 together with the correction parameter. The processor 21 compares environment information at the present time to the environment information recorded in the memory 22 together with the correction parameter. The processor 21 determines whether or not to execute the registration again based on the comparison result.

That is, the processor 21 generates the first main scanning direction correction parameter, the second main scanning direction correction parameter, and the sub-scanning direction correction parameter during start-up, and records the environment information. When the environment information recorded during the generation of the first main scanning direction correction parameter, the second main scanning direction correction parameter, and the sub-scanning direction correction parameter is different from the environment information at the present time, the processor 21 determines to generate the first main scanning direction correction parameter, the second main scanning direction correction parameter, and the sub-scanning direction correction parameter.

When the processor 21 determines that the generation of the correction parameter is not necessary (ACT 11, NO), the processor 21 proceeds to the process of ACT 18 described below.

When the processor 21 determines that the generation of the correction parameter is necessary (ACT 11, YES), the processor 21 controls the image forming unit 19 such that the first test pattern 102 is formed at the normal speed and the first laser power (ACT 12). That is, the processor 21 controls the rotation speed of the polygon mirror 92, the rotation speed of the photosensitive drum 51, the speed at which the recording medium is conveyed by the conveyance mechanism 18, and the moving speed of the primary transfer belt 61 to the normal speed, respectively, and controls the exposure unit 43 such that the laser light is output at the first laser power.

In addition, the processor 21 controls the image forming unit 19 such that the second test pattern 103 is formed at the normal speed and the second laser power (ACT 13). That is, the processor 21 controls the rotation speed of the polygon mirror 92, the rotation speed of the photosensitive drum 51, the speed at which the recording medium is conveyed by the conveyance mechanism 18, and the moving speed of the primary transfer belt 61 to the normal speed, respectively, and controls the exposure unit 43 such that the laser light is output at the second laser power.

In this way, the processor 21 controls the image forming unit 19 such that the first test pattern 102 and the second test pattern 103 are continuously formed on the primary transfer belt 61 at the normal speed. That is, the processor 21 operates the respective units at the normal speed and switches the laser power between first laser power and the second laser power such that the first test pattern 102 and the second test pattern 103 are continuously formed on the primary transfer belt 61. When a plurality of settings are present for the print speed, the processor 21 adopts a fast speed and forms the test pattern at the laser power corresponding to each of the print speeds. The processor 21 may control the image forming unit 19 such that the second test pattern 103 is formed before forming the first test pattern 102.

Figure 4:
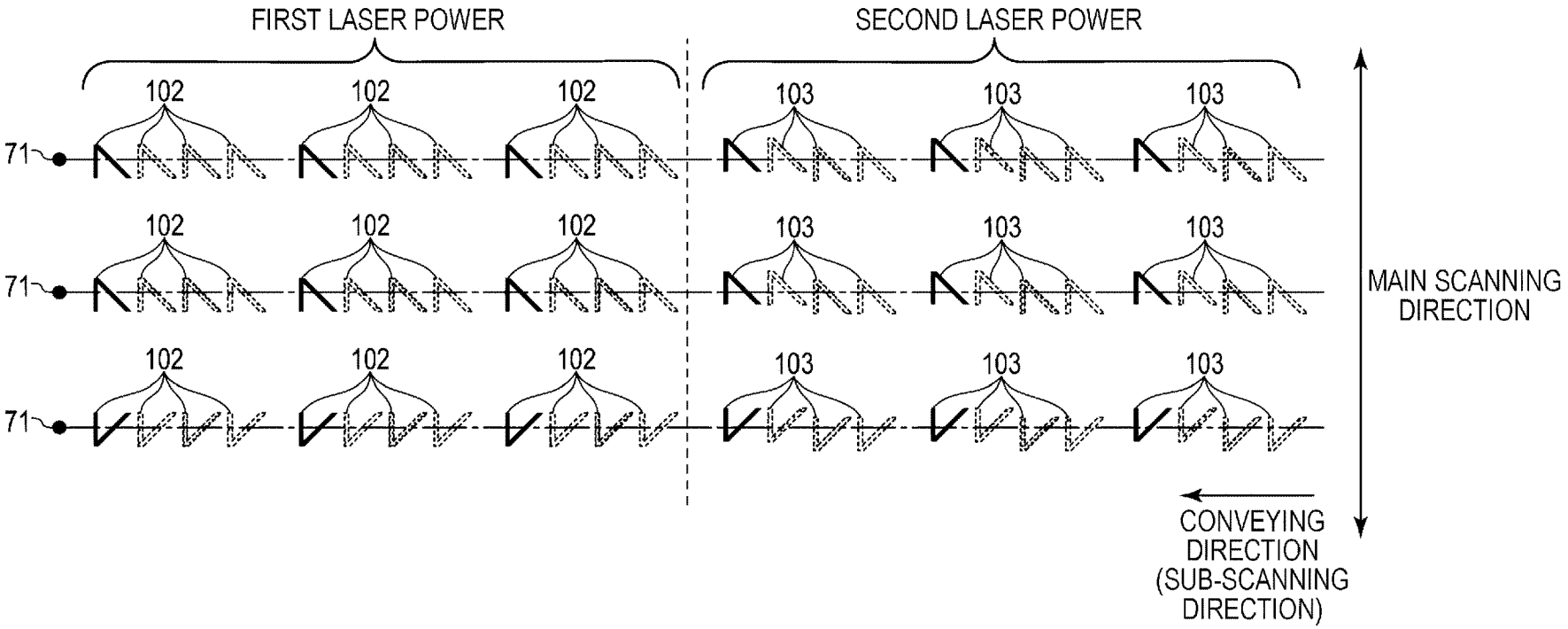
FIG. 4 is a diagram illustrating an example of a test pattern according to at least one embodiment.

In ACT 12 and ACT 13, the test patterns illustrated in FIG. 4 are formed on the primary transfer belt 61. FIG. 4 is a diagram illustrating the positions of the test patterns and the detection positions 71 of the photodetector 45.

In the example of FIG. 4, three test patterns are aligned for each of the colors in the sub-scanning direction, that is, the conveying direction of the primary transfer belt 61. Each of the test patterns is formed to pass through the detection position 71 of the photodetector 45. In addition, as illustrated in FIG. 4, the first test patterns 102 formed at the first laser power are not misregistered in the main scanning direction. On the other hand, the second test patterns 103 formed at the second laser power are misregistered to the downstream side in the main scanning direction.

Next, the processor 21 causes the photodetector 45 to detect the first test pattern 102 and the second test pattern 103 (ACT 14).

The processor 21 generates the sub-scanning direction correction parameter based on the detection result of the first test pattern 102 or the second test pattern 103 by the photodetector 45 (ACT 15). As described above, the processor 21 generates the sub-scanning direction correction parameter for each of the colors based on the time interval between the timings at which the first side of the first test pattern 102 or the second test pattern 103 for each of the colors is detected and the preset first reference value. The processor 21 generates the sub-scanning direction correction parameter, for example, based on the detection result of the first test pattern 102. The processor 21 may be configured to generate the sub-scanning direction correction parameter based on the detection result of the second test pattern 103. In addition, the processor 21 may be configured to generate the sub-scanning direction correction parameter based on the detection results of both the first test pattern 102 and the second test pattern 103. The processor 21 generates the sub-scanning direction correction parameter by using one set including the aligned test patterns of the four colors. The processor 21 stores the generated sub-scanning direction correction parameter in the memory 22.

The processor 21 generates the first main scanning direction correction parameter based on the detection result of the first test pattern 102 (ACT 16). As described above, the processor 21 generates the main scanning direction correction parameter for each of the colors based on the time interval between the timing at which the first side of the first test pattern 102 is detected and the timing at which the second side of the first test pattern 102 is detected and the preset second reference value. The processor 21 stores the generated first main scanning direction correction parameter in the memory 22.

In addition, the processor 21 generates the second main scanning direction correction parameter based on the detection result of the second test pattern 103 (ACT 17). As described above, the processor 21 generates the main scanning direction correction parameter for each of the colors based on the time interval between the timing at which the first side of the second test pattern 103 is detected and the timing at which the second side of the second test pattern 103 is detected and the preset second reference value. The processor 21 stores the generated second main scanning direction correction parameter in the memory 22.

Next, the processor 21 determines whether or not to execute the normal speed printing (ACT 18). The processor 21 determines whether or not to execute the normal speed printing based on the print job.

When the processor 21 determines to execute the normal speed printing (ACT 18, YES), the processor 21 reads the sub-scanning direction correction parameter and the first main scanning direction correction parameter from the memory 22 (ACT 19).

The processor 21 executes the normal speed printing based on the read sub-scanning direction correction parameter and the read first main scanning direction correction parameter (ACT 20) and proceeds to the process of ACT 24. That is, the processor 21 controls a timing at which the exposure unit 43 starts to irradiate the photosensitive drum 51 of each of the process units 42 with laser light based on the read sub-scanning direction correction parameter and the read first main scanning direction correction parameter. As a result, the processor 21 shifts the position of the toner image to be formed on the primary transfer belt 61 in the main scanning direction and the sub-scanning direction. As a result, misregistration that occurs between different colors can be resolved.

In addition, when the processor 21 determines not to execute the normal speed printing in ACT 18, (ACT 18, NO), the processor 21 determines whether or not to execute reduced speed printing (ACT 21). The processor 21 determines whether or not to execute the reduced speed printing based on the print job. When the processor 21 determines not to execute the reduced speed printing (ACT 21, NO), the processor 21 proceeds to the process of ACT 24 described below.

When the processor 21 determines to execute the reduced speed printing (ACT 21, YES), the processor 21 reads the sub-scanning direction correction parameter and the second main scanning direction correction parameter from the memory (ACT 22).

The processor 21 executes the reduced speed printing based on the read sub-scanning direction correction parameter and the read second main scanning direction correction parameter (ACT 23) and proceeds to the process of ACT 24. That is, the processor 21 controls a timing at which the exposure unit 43 starts to irradiate the photosensitive drum 51 of each of the process units 42 with laser light based on the read sub-scanning direction correction parameter and the read second main scanning direction correction parameter. As a result, the processor 21 shifts the position of the toner image to be formed on the primary transfer belt 61 in the main scanning direction and the sub-scanning direction. As a result, misregistration that occurs between different colors can be resolved.

The processor 21 determines whether or not the process ends (ACT 24). When the processor 21 determines not to end the process (ACT 24, NO), and proceeds to the process of ACT 11. When the processor 21 determines to end the processor (ACT 24, YES), the processor 21 ends the process of FIG. 3.

As described above, the image forming apparatus 1 is configured to execute printing at the normal speed as the first print speed or at the reduced speed as the second print speed slower than the first print speed. In the image forming apparatus 1, when the color misregistration correction process is executed, the respective units are controlled at the normal speed such that the first test pattern 102 is formed at the first laser power corresponding to the normal speed printing and the second test pattern 103 is formed at the second laser power corresponding to the reduced speed printing.

The image forming apparatus 1 generates the first main scanning direction correction parameter for the normal speed from the detection result of the first test pattern 102, and generates the second main scanning direction correction parameter for the reduced speed from the second test pattern 103. In addition, the image forming apparatus 1 generates the sub-scanning direction correction parameter for the normal speed and the reduced speed from the detection result of the first test pattern 102.

The image forming apparatus 1 executes the normal speed printing based on the sub-scanning direction correction parameter and the first main scanning direction correction parameter. In addition, the image forming apparatus 1 executes the reduced speed printing based on the sub-scanning direction correction parameter and the second main scanning direction correction parameter.

As a result, the image forming apparatus 1 can reduce a period of time required to generate the correction parameter for the color misregistration correction process for each of the print speeds. As a result, the image forming apparatus 1 can improve the print speed.

The functions described in the respective embodiments are not limited to being configured using hardware, and can also be implemented using software by causing a computer to read programs storing the respective functions. In addition, the respective functions may be configured by appropriately selecting either software or hardware.

While certain embodiments have been described, these embodiments have been presented by way of example only, and are not intended to limit the scope of the disclosure. Indeed, the novel apparatus and methods described herein may be embodied in a variety of other forms; furthermore, various omissions, substitutions and changes in the form of the apparatus and methods described herein may be made without departing from the spirit of the disclosures. The accompanying claims and their equivalents are intended to cover such forms or modifications as would fall within the scope and spirit of the disclosures.

What is claimed is:

1. An image forming apparatus comprising:

a rotatable photoconductor;

a laser light source configured to output laser light based on an image;

a polygon mirror configured to reflect the laser light when the polygon mirror is rotated causing the laser light to be incident on the photoconductor in a main scanning direction to form an electrostatic latent image on the photoconductor;

a developing unit configured to attach toner to the electrostatic latent image to form a toner image;

a transfer mechanism configured to transfer the toner image to an image carrier;

a first photodetector configured to detect the toner image on the image carrier; and a controller configured to:

switch between a first speed printing and a second speed printing, the first speed printing being where the polygon mirror is rotated at a first speed and the laser light source outputs a laser light at a first laser power, and the second speed printing being where the polygon mirror is rotated at a second speed slower than the first speed and the laser light source outputs a laser light at a second laser power lower than the first laser power, cause the polygon mirror to rotate at the first speed and cause the laser light source to output laser light at the first laser power such that a first test pattern is formed on the image carrier, cause the polygon mirror to rotate at the first speed and cause the laser light source to output laser light at the second laser power such that a second test pattern is formed on the image carrier, control the first speed printing based on a detection result of the first test pattern by the first photodetector, and control the second speed printing based on a detection result of the second test pattern by the first photodetector.

2. The apparatus according to claim 1, wherein the controller is configured to maintain the rotation speed of the polygon mirror at the first speed and to switch the laser power of the laser light source between the first laser power and the second laser power such that the first test pattern and the second test pattern are continuously formed on the image carrier.

3. The apparatus according to claim 2, wherein the controller is configured to:

generate a first main scanning direction correction parameter based on the detection result of the first test pattern by the first photodetector, the first main scanning direction correction parameter being used for correcting a print position of the first speed printing in the main scanning direction, and control the first speed printing based on the first main scanning direction correction parameter.

4. The apparatus according to claim 3, wherein the controller is configured to:

generate a second main scanning direction correction parameter based on the detection result of the second test pattern by the first photodetector, the second main scanning direction correction parameter being used for correcting a print position of the second speed printing in the main scanning direction, and control the second speed printing based on the second main scanning direction correction parameter.

5. The apparatus according to claim 4, wherein the controller is configured to, when the first speed printing is switched to the second speed printing, control the second speed printing based on the second main scanning direction correction parameter generated in advance without generating the second main scanning direction correction parameter again.

6. The apparatus according to claim 4, wherein the controller is configured to, when the second speed printing is switched to the first speed printing, control the first speed printing based on the first main scanning direction correction parameter generated in advance without generating the first main scanning direction correction parameter again.

7. The apparatus according to claim 4, wherein the controller is configured to:

generate a sub-scanning direction correction parameter based on the detection result of the first test pattern by the first photodetector or the detection result of the second test pattern by the first photodetector, the sub-scanning direction correction parameter being used for correcting print positions of the first speed printing and the second speed printing in a sub-scanning direction, control the first speed printing based on the first main scanning direction correction parameter and the sub-scanning direction correction parameter, and control the second speed printing based on the second main scanning direction correction parameter and the sub-scanning direction correction parameter.

8. The apparatus according to claim 4, wherein the controller is configured to:

generate the first main scanning direction correction parameter and the second main scanning direction correction parameter during start-up, and generate the first main scanning direction correction parameter and the second main scanning direction correction parameter again when environment information, recorded during the generation of the first main scanning direction correction parameter and the second main scanning direction correction parameter, is different from environment information at a present time.

9. The apparatus according to claim 4, further comprising a second photodetector configured to detect the laser light reflected from the polygon mirror, wherein the controller is configured to:

determine an exposure start position, where exposure by the laser light source starts secondly, based on a detection result by the second photodetector, and control of the exposure start position of the first speed printing based on the first main scanning direction correction parameter.

10. The apparatus according to claim 9, wherein the controller is configured to control the exposure start position of the second speed printing based on the second main scanning direction correction parameter.

11. The apparatus according to claim 1, wherein the controller is configured to form the second test pattern after the first test pattern.

12. The apparatus according to claim 1, wherein the first test pattern and the second test pattern each include a plurality of test patterns having different colors.

13. A method of operating an image forming apparatus including a laser light source configured to output laser light according to an image, a polygon mirror configured to reflect the laser light while the polygon mirror is rotated causing the laser light to be incident on a photoconductor in a main scanning direction to form an electrostatic latent image, and a first photodetector configured to detect a toner image, based on the electrostatic latent image, formed on an image carrier, the method comprising:

switching between a first speed printing and a second speed printing, the first speed printing being where a rotation speed of the polygon mirror is a first speed and laser light is output from the laser light source at a first laser power, the second speed printing being where a rotation speed of the polygon mirror is a second speed slower than the first speed and laser light is output from the laser light source at a second laser power lower than the first laser power, rotating the polygon mirror at the first speed and outputting laser light from the laser light source at the first laser power such that a first test pattern is formed on the image carrier, rotating the polygon mirror at the first speed and outputting laser light from the laser light source at the second laser power such that a second test pattern is formed on the image carrier, controlling the first speed printing based on a detection result of the first test pattern by the first photodetector, and controlling the second speed printing based on a detection result of the second test pattern by the first photodetector.

14. The method according to claim 13, further comprising maintaining the rotation speed of the polygon mirror at the first speed and switching the laser power of the laser light source between the first laser power and the second laser power such that the first test pattern and the second test pattern are continuously formed on the image carrier.

15. The method according to claim 14, further comprising:

generating a first main scanning direction correction parameter based on the detection result of the first test pattern by the first photodetector, the first main scanning direction correction parameter being used for correcting a print position of the first speed printing in the main scanning direction, and controlling the first speed printing based on the first main scanning direction correction parameter.

16. The method according to claim 15, further comprising:

generating a second main scanning direction correction parameter based on the detection result of the second test pattern by the first photodetector, the second main scanning direction correction parameter being used for correcting a print position of the second speed printing in the main scanning direction, and controlling the second speed printing based on the second main scanning direction correction parameter.

17. The method according to claim 16, wherein, when the first speed printing is switched to the second speed printing, controlling the second speed printing based on the second main scanning direction correction parameter generated in advance without generating the second main scanning direction correction parameter again.

18. The method according to claim 16, wherein, when the second speed printing is switched to the first speed printing, controlling the first speed printing based on the first main scanning direction correction parameter generated in advance without generating the first main scanning direction correction parameter again.

19. The method according to claim 16, further comprising:

generating a sub-scanning direction correction parameter based on the detection result of the first test pattern by the first photodetector or the detection result of the second test pattern by the first photodetector, the sub-scanning direction correction parameter being used for correcting print positions of the first speed printing and the second speed printing in a sub-scanning direction, controlling the first speed printing based on the first main scanning direction correction parameter and the sub-scanning direction correction parameter, and controlling the second speed printing based on the second main scanning direction correction parameter and the sub-scanning direction correction parameter.

20. The method according to claim 16, further comprising:

generating the first main scanning direction correction parameter and the second main scanning direction correction parameter during start-up, and generating the first main scanning direction correction parameter and the second main scanning direction correction parameter again when environment information, recorded during the generation of the first main scanning direction correction parameter and the second main scanning direction correction parameter, is different from environment information at a present time.

* * * * *